US010526868B2

(12) United States Patent
Walton et al.

(10) Patent No.: US 10,526,868 B2
(45) Date of Patent: Jan. 7, 2020

(54) DEGRADABLE WELLBORE ISOLATION DEVICES WITH VARYING FABRICATION METHODS

(71) Applicant: Halliburton Energy Services, Inc., Houston, TX (US)

(72) Inventors: Zachary William Walton, Carrollton, TX (US); Michael Linley Fripp, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 130 days.

(21) Appl. No.: 14/896,679

(22) PCT Filed: Aug. 13, 2015

(86) PCT No.: PCT/US2015/044999
§ 371 (c)(1),
(2) Date: Dec. 8, 2015

(87) PCT Pub. No.: WO2016/025682
PCT Pub. Date: Feb. 18, 2016

(65) Prior Publication Data

US 2016/0201425 A1 Jul. 14, 2016

Related U.S. Application Data

(63) Continuation of application No. PCT/US2014/050993, filed on Aug. 14, 2014.

(51) Int. Cl.
*E21B 29/00* (2006.01)
*E21B 33/129* (2006.01)
(Continued)

(52) U.S. Cl.
CPC ..... *E21B 33/134* (2013.01); *E21B 33/1208* (2013.01)

(58) Field of Classification Search
CPC ..... E21B 33/12; E21B 29/00; E21B 33/129; E21B 33/1291; E21B 33/1293; E21B 33/1294; E21B 33/1295
See application file for complete search history.

(56) References Cited

U.S. PATENT DOCUMENTS 7,168,494 B2 1/2007 Starr et al.
8,307,892 B2 11/2012 Frazier
(Continued)

FOREIGN PATENT DOCUMENTS

WO WO-2013169418 A1 11/2013
WO WO-2014014591 A1 1/2014
(Continued)

OTHER PUBLICATIONS

International Search Report and Written Opinion for PCT/US2015/044999 dated Oct. 26, 2015.
(Continued)

*Primary Examiner* — Kipp C Wallace
(74) *Attorney, Agent, or Firm* — McGuireWoods LLP

(57) ABSTRACT

Downhole tools, methods, and systems of use thereof, the downhole tool comprising a wellbore isolation device that provides a plurality of components including one or more first components and one or more second components, wherein at least the first and second one or more components are made of a degradable metal material that degrades when exposed to a wellbore environment, and wherein the one or more first components is fabricated by a first fabrication method and the one or more second components is fabricated by a second fabrication method.

11 Claims, 2 Drawing Sheets

(51) Int. Cl.
*E21B 33/134* (2006.01)
*E21B 33/12* (2006.01)

(56) References Cited

U.S. PATENT DOCUMENTS

| | | | | |
|---|---|---|---|---|
| 8,746,342 | B1 | 6/2014 | Nish et al. | |
| 8,877,831 | B2 | 11/2014 | Roddy et al. | |
| 2005/0205266 | A1 | 9/2005 | Todd et al. | |
| 2006/0113077 | A1 | 6/2006 | Willberg et al. | |
| 2010/0270031 | A1* | 10/2010 | Patel | E21B 33/1208 166/376 |
| 2011/0048743 | A1 | 3/2011 | Stafford et al. | |
| 2011/0067889 | A1 | 3/2011 | Marya et al. | |
| 2011/0186306 | A1 | 8/2011 | Marya et al. | |
| 2012/0006561 | A1 | 1/2012 | Johnson et al. | |
| 2012/0273229 | A1 | 11/2012 | Xu et al. | |
| 2012/0276356 | A1* | 11/2012 | Xu | E21B 41/00 428/218 |
| 2012/0318513 | A1 | 12/2012 | Mazyar et al. | |
| 2013/0043041 | A1 | 2/2013 | McCoy et al. | |
| 2013/0048305 | A1 | 2/2013 | Xu et al. | |
| 2013/0112429 | A1* | 5/2013 | Crews | C09K 8/52 166/376 |
| 2013/0300066 | A1* | 11/2013 | Xu | E21B 33/12 277/336 |
| 2013/0327540 | A1 | 12/2013 | Hamid et al. | |
| 2014/0014339 | A1 | 1/2014 | O'Malley et al. | |
| 2014/0110112 | A1* | 4/2014 | Jordan, Jr. | E21B 33/1293 166/281 |
| 2014/0158378 | A1* | 6/2014 | Xu | E21B 43/103 166/384 |
| 2014/0190685 | A1 | 7/2014 | Frazier et al. | |
| 2014/0190705 | A1 | 7/2014 | Fripp et al. | |
| 2014/0202708 | A1 | 7/2014 | Jacob et al. | |
| 2015/0129239 | A1 | 5/2015 | Richard | |
| 2015/0247376 | A1* | 9/2015 | Tolman | E21B 33/12 166/297 |
| 2015/0337618 | A1* | 11/2015 | Hern | E21B 33/1208 166/376 |
| 2016/0273300 | A1 | 9/2016 | Walton et al. | |
| 2017/0158942 | A1 | 6/2017 | Okura et al. | |

FOREIGN PATENT DOCUMENTS

| | | | |
|---|---|---|---|
| WO | 2016025682 | A1 | 2/2016 |
| WO | WO-2016024974 | A1 | 2/2016 |

OTHER PUBLICATIONS

Canadian Office Action from Canadian Patent Application No. 2,952,650, dated Oct. 17, 2017, 4 pages.
Canadian Office Action from Canadian Patent Application No. 2,952,007, dated Nov. 8, 2017, 3 pages.

* cited by examiner

DEGRADABLE WELLBORE ISOLATION DEVICES WITH VARYING FABRICATION METHODS

CROSS-REFERENCE TO RELATED APPLICATION

This application is a continuation-in-part of PCT/US2014/050993, titled "Degradable Wellbore Isolation Devices with Varying Degradation Rates," and filed Aug. 14, 2014.

BACKGROUND

The present disclosure generally relates to downhole tools used in the oil and gas industry and, more particularly, to degradable wellbore isolation devices having at least two fabrication methods.

In the drilling, completion, and stimulation of hydrocarbon-producing wells, a variety of downhole tools are used. For example, it is often desirable to seal portions of a wellbore, such as during fracturing operations when various fluids and slurries are pumped from the surface into the casing string and forced out into a surrounding subterranean formation. It thus becomes necessary to seal the wellbore and thereby provide zonal isolation. Wellbore isolation devices, such as packers, bridge plugs, and fracturing plugs (i.e., "frac" plugs) are designed for these general purposes and are well known in the art of producing hydrocarbons, such as oil and gas. Such wellbore isolation devices may be used in direct contact with the formation face of the wellbore, with a casing string extended and secured within the wellbore, or with a screen or wire mesh.

After the desired downhole operation is complete, the seal formed by the wellbore isolation device must be broken and the tool itself removed from the wellbore. Removing the wellbore isolation device may allow hydrocarbon production operations to commence without being hindered by the presence of the downhole tool. Removing wellbore isolation devices, however, is traditionally accomplished by a complex retrieval operation that involves milling or drilling out a portion of the wellbore isolation device, and subsequently mechanically retrieving its remaining portions. To accomplish this, a tool string having a mill or drill bit attached to its distal end is introduced into the wellbore and conveyed to the wellbore isolation device to mill or drill out the wellbore isolation device. After drilling out the wellbore isolation device, the remaining portions of the wellbore isolation device may be grasped onto and retrieved back to the surface with the tool string for disposal.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

Figure 1:
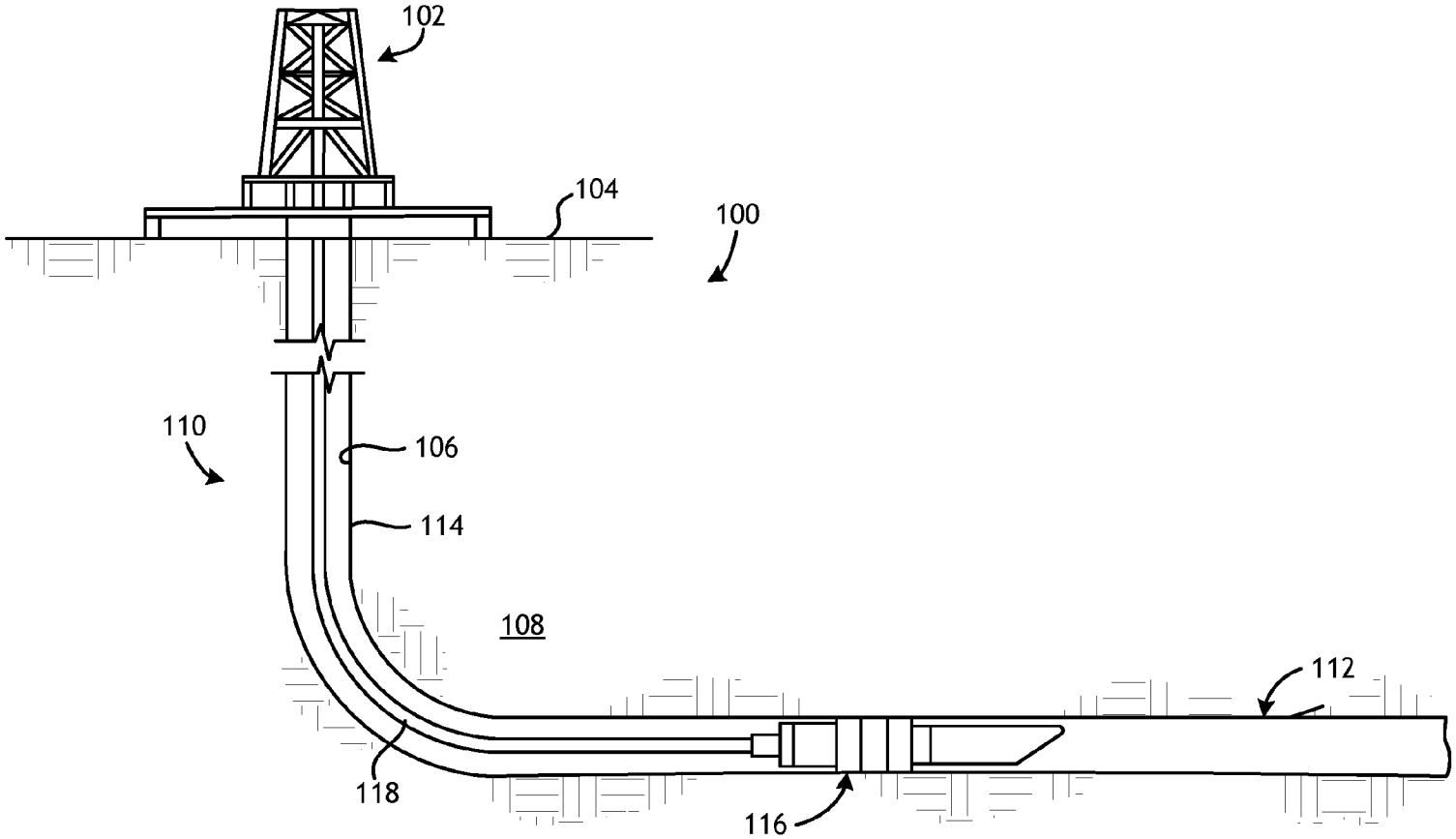
FIG. 1 is a well system that can employ one or more principles of the present disclosure, according to one or more embodiments.

The present disclosure generally relates to downhole tools used in the oil and gas industry and, more particularly, to degradable wellbore isolation devices having at least two fabrication methods.

The present disclosure describes embodiments of wellbore isolation devices that include multiple structural components that are made of degradable metal materials formed from at least two fabrication methods. The structural components may be made of degradable metal materials that exhibit predetermined or unique degradation rates such that the components may degrade at varying degradation rates to avoid premature detachment of the wellbore isolation device from within a wellbore. Such degradation rate variations may be the result of the degradable metal material itself and/or the fabrication method for forming the structural component of the wellbore isolation device with the degradable metal material. In at least one embodiment, one or more of the components that anchor the wellbore isolation device in the wellbore may exhibit a degradation rate that is greater than the degradation rate of other structural components of the wellbore isolation device.

One or more illustrative embodiments disclosed herein are presented below. Not all features of an actual implementation are described or shown in this application for the sake of clarity. It is understood that in the development of an actual embodiment incorporating the embodiments disclosed herein, numerous implementation-specific decisions must be made to achieve the developer's goals, such as compliance with system-related, lithology-related, business-related, government-related, and other constraints, which vary by implementation and from time to time. While a developer's efforts might be complex and time-consuming, such efforts would be, nevertheless, a routine undertaking for those of ordinary skill in the art having benefit of this disclosure.

It should be noted that when "about" is provided herein at the beginning of a numerical list, the term modifies each number of the numerical list. In some numerical listings of ranges, some lower limits listed may be greater than some upper limits listed. One skilled in the art will recognize that the selected subset will require the selection of an upper limit in excess of the selected lower limit. Unless otherwise indicated, all numbers expressing quantities of ingredients, properties such as molecular weight, reaction conditions, and so forth used in the present specification and associated claims are to be understood as being modified in all instances by the term "about." As used herein, the term "about" encompasses +/−5% of each numerical value. For example, if the numerical value is "about 80%," then it can be 80% +/−5%, equivalent to 76% to 84%. Accordingly, unless indicated to the contrary, the numerical parameters set forth in the following specification and attached claims are approximations that may vary depending upon the desired properties sought to be obtained by the exemplary embodiments described herein. At the very least, and not as an attempt to limit the application of the doctrine of equivalents to the scope of the claim, each numerical parameter should at least be construed in light of the number of reported significant digits and by applying ordinary rounding techniques.

While compositions and methods are described herein in terms of "comprising" various components or steps, the compositions and methods can also "consist essentially of" or "consist of" the various components and steps. When "comprising" is used in a claim, it is open-ended.

As used herein, the term "substantially" means largely, but not necessarily wholly.

The use of directional terms such as above, below, upper, lower, upward, downward, left, right, uphole, downhole and the like, are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well.

The downhole tools described herein are wellbore isolation devices comprising a plurality of components (e.g., structural components) including one or more first components and one or more second components, wherein at least the one or more first components and the one or more second components are composed of a degradable metal material that degrades when exposed to a wellbore environment. Accordingly, the wellbore isolation device may have one or more additional components that is made of a material that is not a degradable metal material, such as a plastic, a polymer, a non-degradable metal, or a degradable non-metal, and the like, without departing from the scope of the present disclosure, provided that the downhole tool is capable of sufficient degradation for use in a particular downhole operation. For example, the wellbore isolation device may have a packer element, as described in more detail below, composed of an elastomer or a degradable elastomer.

The one or more first components and the one or more second components of the wellbore isolation device are composed of degradable metal materials fabricated by different fabrication methods. For example, the one or more first components is fabricated by a first fabrication method and the one or more second components is fabricated by a second fabrication method that is different than the first fabrication method. The variation of the fabrication methods may be used to impart varying qualities to the first and second components. For example, a fabrication method may be selected to impart structural integrity (e.g., strength), such as for use in forming a mandrel or structurally rigid component of the wellbore isolation device. In other embodiments, a fabrication method may be selected for cost minimization of a particular component without compromising the function of the component (e.g., for minimizing the cost of a mule shoe). In yet other embodiments, the fabrication method may be selected to enhance or hinder degradation of the particular degradable metal material component. Accordingly, at least two degradable metal components of the wellbore isolation devices described herein are formed from at least two fabrication methods. It will be appreciated, however, that more than two components of the wellbore isolation devices may be composed of a degradable metal material and may be formed by one or two fabrication methods, or greater than two fabrication methods, without departing from the scope of the present disclosure.

In use, the wellbore isolation devices of the present disclosure are anchored within a wellbore in a subterranean formation at a target location. Thereafter, at least one downhole operation (e.g., a fracturing operation), as discussed in greater detail below, prior to degrading the degradable metal material components (or other degradable components) such that the structural integrity of the wellbore isolation device is lost.

As used herein, the term "degradable" and all of its grammatical variants (e.g., "degrade," "degradation," "degrading," and the like) refers to the dissolution, galvanic conversion, or chemical conversion of solid materials such that a reduced structural integrity results. In complete degradation, structural shape is lost. The degradable metal materials described herein may degrade by galvanic corrosion in the presence of an electrolyte. As used herein, the term "electrolyte" refers to a conducting medium containing ions (e.g., a salt). The term "galvanic corrosion" refers to corrosion occurring when two different metals or metal alloys are in electrical connectivity with each other and both are in contact with an electrolyte. The term "galvanic corrosion" includes microgalvanic corrosion. As used herein, the term "electrical connectivity" means that the two different metals or metal alloys are either touching or in close proximity to each other such that when contacted with an electrolyte, the electrolyte becomes electrically conductive and ion migration occurs between one of the metals and the other metal. As used herein, a "degradable metal material" (also referred to simply as "degradable metal" herein) may refer to the rate of dissolution of the degradable metal material, and the rate of dissolution may correspond to a rate of material loss at a particular temperature and within a particular wellbore environment, such as in the presence of an electrolyte.

The conditions for degradation of the degradable metal materials described herein are wellbore conditions where an external stimulus may be used to initiate or affect the rate of degradation, or where the naturally occurring environment within the wellbore initiates or affects the rate of degradation. For example, the salinity or pH of a fluid that interacts with the degradable metal material affect degradation and may by adjusted, such as by the addition of salt (or ions), or an acid or base compound. The term "wellbore environment" includes both naturally occurring wellbore environments and introduced materials or fluids into the wellbore. As discussed in detail below, degradation of the degradable metal materials identified herein may be accelerated, rapid, or normal, degrading anywhere from about 30 minutes to about 40 days from first contact with an appropriate wellbore environment, or from about 4 hours to about 24 days from first contact with an appropriate wellbore environment, encompassing any value and subset therebetween.

In some embodiments, the wellbore environment capable of stimulating or otherwise affecting degradation of the degradable metal materials described herein comprises an electrolyte, either naturally produced or introduced into the wellbore (e.g., introduced to perform an operation, such as an electrolytic fracturing fluid). Such electrolytes may include, but are not limited to, a halide anion (i.e., fluoride, chloride, bromide, iodide, and astatide), a halide salt, an oxoanion (including monomeric oxoanions and polyoxoanions), and any combination thereof. Suitable examples of halide salts for use as the electrolytes of the present disclosure may include, but are not limited to, a potassium fluoride, a potassium chloride, a potassium bromide, a potassium iodide, a sodium chloride, a sodium bromide, a sodium iodide, a sodium fluoride, a calcium fluoride, a calcium chloride, a calcium bromide, a calcium iodide, a zinc fluoride, a zinc chloride, a zinc bromide, a zinc iodide, an ammonium fluoride, an ammonium chloride, an ammonium bromide, an ammonium iodide, a magnesium chloride, potassium carbonate, potassium nitrate, sodium nitrate, and any combination thereof. The oxyanions for use as the electrolyte of the present disclosure may be generally represented by the formula $A_xO_y^{z-}$, where A represents a chemical element and O is an oxygen atom; x, y, and z are integers between the range of about 1 to about 30, and may be or may not be the same integer. Examples of suitable oxoanions may include, but are not limited to, carbonate, borate, nitrate, phosphate, sulfate, nitrite, chlorite, hypochlorite, phosphite, sulfite, hypophosphite, hyposulfite, triphosphate, and any combination thereof.

In some embodiments, the electrolyte may be present in an aqueous base fluid including, but not limited to, fresh water, saltwater (e.g., water containing one or more salts dissolved therein), brine (e.g., saturated salt water), seawater, and any combination thereof. Generally, the water in the aqueous base fluid may be from any source, provided that it does not interfere with the electrolyte therein from degrading at least partially the degradable metal materials forming components of the wellbore isolation device. In some embodiments, the electrolyte may be present in the aqueous base fluid up to saturation for contacting the degradable metal material components of the wellbore isolation device in a subterranean formation, which may vary depending on the type of degradable metal material and aqueous base fluid selected. In other embodiments, the electrolyte may be present in the aqueous base fluid in the range of from about 0.01% to about 30% by weight of the aqueous base fluid, encompassing any value and subset therebetween. For example, the electrolyte may be present of from about 0.01% to about 6%, or about 6% to about 12%, or about 12% to about 18%, or about 18% to about 24%, or about 24% to about 30% by weight of the aqueous base fluid. Each of these values is critical to the embodiments of the present disclosure and may depend on a number of factors including, but not limited to, the composition of the degradable metal material, the components of the wellbore isolation device composed of the degradable metal material, the type of electrolyte selected, other conditions of the wellbore environment, and the like. As used herein the term "degrading at least partially" or "partially degrades" with reference to degradation of the wellbore isolation device or component thereof refers to the device or component degrading at least to the point wherein about 20% or more of the mass of the tool or component degrades.

Referring now to FIG. 1, illustrated is a well system 100 that may embody or otherwise employ one or more principles of the present disclosure, according to one or more embodiments. As illustrated, the well system 100 may include a service rig 102 that is positioned on the earth's surface 104 and extends over and around a wellbore 106 that penetrates a subterranean formation 108. The service rig 102 may be a drilling rig, a completion rig, a workover rig, or the like. In some embodiments, the service rig 102 may be omitted and replaced with a standard surface wellhead completion or installation, without departing from the scope of the disclosure. While the well system 100 is depicted as a land-based operation, it will be appreciated that the principles of the present disclosure could equally be applied in any sea-based or sub-sea application where the service rig 102 may be a floating platform or sub-surface wellhead installation, as generally known in the art.

The wellbore 106 may be drilled into the subterranean formation 108 using any suitable drilling technique and may extend in a substantially vertical direction away from the earth's surface 104 over a vertical wellbore portion 110. At some point in the wellbore 106, the vertical wellbore portion 110 may deviate from vertical relative to the earth's surface 104 and transition into a substantially horizontal wellbore portion 112. In some embodiments, the wellbore 106 may be completed by cementing a casing string 114 within the wellbore 106 along all or a portion thereof. In other embodiments, however, the casing string 114 may be omitted from all or a portion of the wellbore 106 and the principles of the present disclosure may equally apply to an "open-hole" environment.

The system 100 may further include a wellbore isolation device 116 that may be conveyed into the wellbore 106 on a conveyance 118 that extends from the service rig 102. The wellbore isolation device 116 may include or otherwise comprise any type of casing or borehole isolation device (collectively referred to as "wellbore isolation devices") known to those skilled in the art including, but not limited to, a frac plug, a bridge plug, a wellbore packer, a wiper plug, a cement plug, a basepipe plug, a sand screen plug, an inflow control device (ICD) plug, an autonomous ICD plug, a tubing section, or a tubing string. The conveyance 118 that delivers the wellbore isolation device 116 downhole may be, but is not limited to, wireline, slickline, an electric line, coiled tubing, drill pipe, production tubing, or the like.

The wellbore isolation device 116 may be conveyed downhole to a target location (not shown) within the wellbore 106. At the target location, the wellbore isolation device may be actuated or "set" to seal the wellbore 106 and otherwise provide a point of fluid isolation within the wellbore 106. In some embodiments, the wellbore isolation device 116 is pumped to the target location using hydraulic pressure applied from the service rig 102 at the surface 104. In such embodiments, the conveyance 118 serves to maintain control of the wellbore isolation device 116 as it traverses the wellbore 106 and provides the necessary power to actuate and set the wellbore isolation device 116 upon reaching the target location. In other embodiments, the wellbore isolation device 116 freely falls to the target location under the force of gravity to traverse all or part of the wellbore 106.

It will be appreciated by those skilled in the art that even though FIG. 1 depicts the wellbore isolation device 116 as being arranged and operating in the horizontal portion 112 of the wellbore 106, the embodiments described herein are equally applicable for use in portions of the wellbore 106 that are vertical, deviated, or otherwise slanted.

Figure 2:
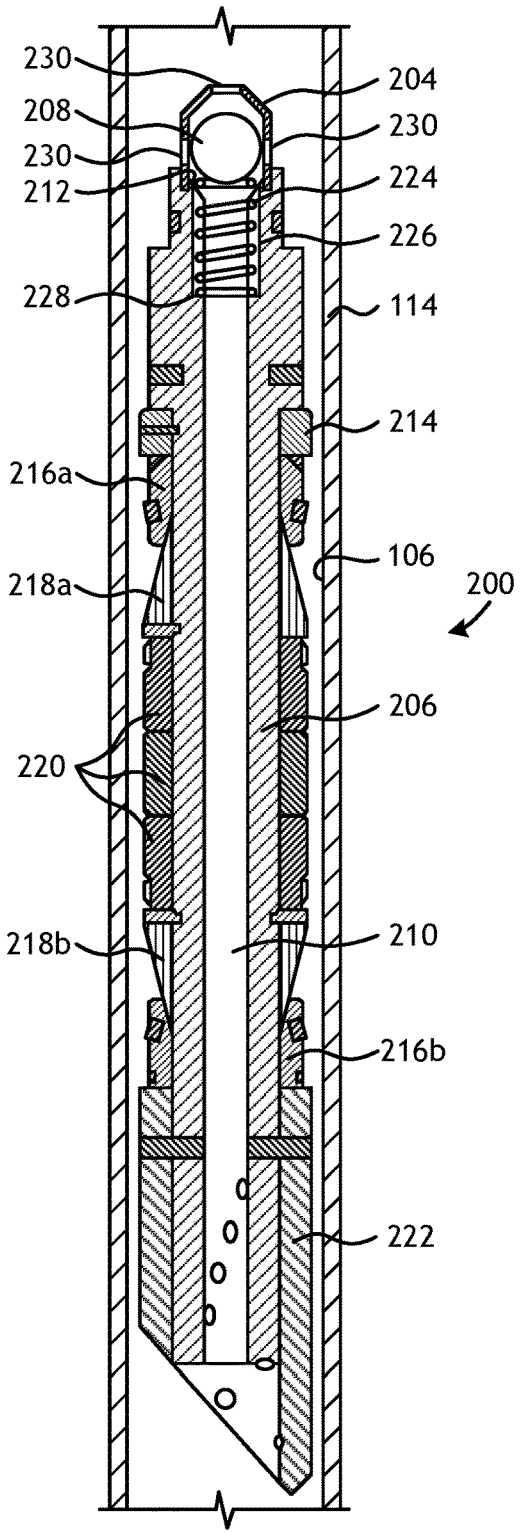
FIG. 2 illustrates a cross-sectional view of an exemplary wellbore isolation device that can employ one or more principles of the present disclosure, according to one or more embodiments.

Referring now to FIG. 2, with continued reference to FIG. 1, illustrated is a cross-sectional view of an exemplary wellbore isolation device 200 that may employ one or more of the principles of the present disclosure, according to one or more embodiments. The wellbore isolation device 200 may be similar to or the same as the wellbore isolation device 116 of FIG. 1. Accordingly, the wellbore isolation device 200 may be configured to be extended into and seal the wellbore 106 at a target location, and thereby prevent fluid flow past the wellbore isolation device 200 for wellbore completion or stimulation operations. In some embodiments, as illustrated, the wellbore 106 may be lined with the casing 114 or another type of wellbore liner or tubing in which the wellbore isolation device 200 may suitably be set. In other embodiments, however, the casing 114 may be omitted and the wellbore isolation device 200 may instead be set in an "open-hole" environment.

The wellbore isolation device 200 is generally depicted and described herein as a hydraulic frac plug. It will be appreciated by those skilled in the art, however, that the principles of this disclosure may equally be applied to any of the other aforementioned types of casing or borehole isolation devices or any other wellbore isolation devices, without departing from the scope of the disclosure. Indeed, the wellbore isolation device 200 may be any of a frac plug, a bridge plug, a wellbore packer, a wiper plug, a cement plug, a basepipe plug, a sand screen plug, an ICD plug, an autonomous ICD plug, a tubing section, or a tubing string in keeping with the principles of the present disclosure.

As illustrated, the wellbore isolation device 200 may include a ball cage 204 extending from or otherwise coupled to the upper end of a mandrel 206. A sealing or "frac" ball 208 is disposed in the ball cage 204 and the mandrel 206 defines a longitudinal central flow passage 210. The mandrel 206 also defines a ball seat 212 at its upper end. One or more spacer rings 214 (one shown) may be secured to the mandrel 206 and otherwise extend thereabout. The spacer ring 214 provides an abutment, which axially retains a set of upper slips 216*a* that are also positioned circumferentially about the mandrel 206. As illustrated, a set of lower slips 216*b* may be arranged distally from the upper slips 216*a*.

One or more slip wedges 218 (shown as upper and lower slip wedges 218*a* and 218*b*, respectively) may also be positioned circumferentially about the mandrel 206, and a packer assembly consisting of one or more expandable or inflatable packer elements 220 may be disposed between the upper and lower slip wedges 218*a,b* and otherwise arranged about the mandrel 206. It will be appreciated that the particular packer assembly depicted in FIG. 2 is merely representative as there are several packer arrangements known and used within the art. For instance, while three packer elements 220 are shown in FIG. 2, the principles of the present disclosure are equally applicable to wellbore isolation devices that employ more or less than three packer elements 220, without departing from the scope of the disclosure.

A mule shoe 222 may be positioned at or otherwise secured to the mandrel 206 at its lower or distal end. As will be appreciated, the lower most portion of the wellbore isolation device 200 need not be a mule shoe 222, but could be any type of section that serves to terminate the structure of the wellbore isolation device 200, or otherwise serves as a connector for connecting the wellbore isolation device 200 to other tools, such as a valve, tubing, or other downhole equipment.

In some embodiments, a spring 224 may be arranged within a chamber 226 defined in the mandrel 206 and otherwise positioned coaxial with and fluidly coupled to the central flow passage 210. At one end, the spring 224 biases a shoulder 228 defined by the chamber 226 and at its opposing end the spring 224 engages and otherwise supports the frac ball 208. The ball cage 204 may define a plurality of ports 230 (three shown) that allow the flow of fluids therethrough, thereby allowing fluids to flow through the length of the wellbore isolation device 200 via the central flow passage 210.

As the wellbore isolation device 200 is lowered into the wellbore 106, the spring 224 prevents the frac ball 208 from engaging the ball seat 212. As a result, fluids may pass through the wellbore isolation device 200; i.e., through the ports 230 and central flow passage 210. The ball cage 204 retains the frac ball 208 such that it is not lost during translation into the wellbore 106 to its target location. Once the wellbore isolation device 200 reaches the target location, a setting tool (not shown) of a type known in the art can be utilized to move the wellbore isolation device 200 from its unset position (shown in FIG. 2) to a set position. The setting tool may operate via various mechanisms to anchor the wellbore isolation device 200 in the wellbore 106 including, but not limited to, hydraulic setting, mechanical setting, setting by swelling, setting by inflation, setting by sliding, and the like. In the set position, the slips 216*a,b*, the wedges 218*a,b*, and the packer elements 220 cooperate together to engage the inner walls of the casing 114 and anchor the wellbore isolation device 200 in the wellbore 106. Accordingly, the slips 216*a,b*, the wedges 218*a,b*, and the packer elements 220 may be collectively referred to as an "anchoring mechanism." Such an anchoring mechanism operates by expanding the slips 216*a,b* by sliding past the wedges 218*a,b*, and by expanding the packer elements 220 against the wellbore 106.

When it is desired to seal the wellbore 106 at the target location with the wellbore isolation device 200, fluid is injected into the wellbore 106 and conveyed to the wellbore isolation device 200 at a predetermined flow rate that overcomes the spring force of the spring 224. As the fluid flow overcomes the spring force of the spring 224, the frac ball 208 is forced downwardly until it sealingly engages the ball seat 212. When the frac ball 208 is engaged with the ball seat 212 and the packer elements 220 are in their set position, fluid flow past or through the wellbore isolation device 200 in the downhole direction is effectively prevented. At that point, downhole operations, such as completion or stimulation operations may be undertaken by injecting a treatment or completion fluid into the wellbore 106 and forcing the treatment/completion fluid out of the wellbore 106 and into a subterranean formation above the wellbore isolation device 200.

It will be appreciated that although FIG. 2 depicts the frac ball 208 disposed in the ball cage 204 to be later released to engage the ball seat 212, the frac ball 208 may be otherwise provided, without departing from the scope of the present disclosure. For example, in some embodiments, the frac ball 208 is dropped into the wellbore 106 after the wellbore isolation device 200 has been set, such that it traverses the wellbore 106 until it reaches the wellbore isolation device 200 to which it is designed to mate, where the frac ball 208 then engages the ball seat 212 to affect fluid flow.

Following completion and/or stimulation operations, the wellbore isolation device 200 must be removed from the wellbore 106 in order to allow production operations to effectively occur without being hindered by the emplacement of the wellbore isolation device 200. According to the present disclosure, at least two components of the wellbore isolation device 200 may be made of or otherwise comprise a degradable metal material configured to degrade or dissolve and thereby be removed from the wellbore isolation device 200 from the wellbore 106 at the target location. Exemplary components of the wellbore isolation device 200 that may be made of or otherwise comprise a degradable metal material including, but are not limited to, the mandrel 206, the ball cage 208, the frac ball 208, the ball seat 212, the upper and lower slips 216*a,b*, the upper and lower slip wedges 218*a,b*, the mule shoe 222, the spacer ring 214, the spring 224, the chamber 226, the packer element(s) 220, and any combination thereof. In addition to the foregoing, other components of the wellbore isolation device 200 may be made of or otherwise comprise a degradable metal material including, but not limited to, extrusion limiters, a retainer ring, backup shoe, a flapper, a sleeve, a perforation gun housing, a cement dart, a wiper dart, a slip block (e.g., to prevent sliding sleeves from translating), a logging tool, a housing, a release mechanism, a pumpdown tool, a plug, a coupling, a connector, a support, an enclosure, a tapered shoe, or any other downhole tool or component thereof associated with a wellbore isolation device. The foregoing structural elements or components of the wellbore isolation device 200 are collectively referred to herein as "the components" or "the structural components" herein and in the following discussion.

Each of the components of the wellbore isolation device 200 may be made of a degradable metal material that exhibits a predetermined or unique degradation rate. That degradation rate or other characteristics (e.g., strength) can further be altered by fabricating the component with a particular degradable metal material and a particular fabrication method, as discussed in greater detail below. The degradation rate of a given degradable metal material may be accelerated, rapid, or normal, as defined herein. Accelerated degradation may be in the range of from about 30 minutes to about 12 hours, encompassing any value or subset therebetween. Rapid degradation may be in the range of from about 12 hours to about 10 days, encompassing any value or subset therebetween. Normal degradation may be in the range of from about 12 days to about 40 days, encompassing any value or subset therebetween. Accordingly, degradation of the degradable metal material may be between about 30 minutes to about 40 days, depending on a number of factors including, but not limited to, the type of degradable metal material selected, the conditions of the wellbore environment (e.g., the type of electrolyte present), the fabrication method of the component made of the degradable metal material, and the like.

In at least one embodiment, the degradable metal materials described herein exhibit an average degradation rate in an amount of greater than about 0.01 milligrams per square centimeters ($mg/cm^2$) per hour at 93° C. (equivalent to about 200° F.) while exposed to a 15% potassium chloride (KCl) solution. For example, in some embodiments, the degradable metal materials may have an average degradation rate in the range of from about 0.01 $mg/cm^2$ to about 10 $mg/cm^2$ per hour at a temperature of about 93° C. while exposed to a 15% KCl solution, encompassing any value and subset therebetween. For example, the degradation rate may be about 0.01 $mg/cm^2$ to about 2.5 $mg/cm^2$, or about 2.5 $mg/cm^2$ to about 5 $mg/cm^2$, or about 5 $mg/cm^2$ to about 7.5 $mg/cm^2$, or about 7.5 $mg/cm^2$ to about 10 $mg/cm^2$ per hour at a temperature of 93° C. while exposed to a 15% KCl solution, encompassing any value and subset therebetween. In other instances, the degradable metal material may exhibit a degradation rate such that it loses greater than about 0.1% of its total mass per day at 93° C. in a 15% KCl solution. For example, in some embodiments, the degradable metal materials described herein may have a degradation rate such that it loses about 0.1% to about 10% of its total mass per day at 93° C. in a 15% KCl solution, encompassing any value and subset therebetween. For example, in some embodiments the degradable metal material may lose about 0.1% to about 2.5%, or about 2.5% to about 5%, or about 5% to about 7.5%, or about 7.5% to about 10% of its total mass per day at 93° C. in a 15% KCl solution, encompassing any value and subset therebetween. Each of these values representing the degradable metal material is critical to the embodiments of the present disclosure and may depend on a number of factors including, but not limited to, the type of degradable metal material, the wellbore environment, and the like.

It should be noted that the various degradation rates noted in a 15% KCl solution are merely a means of defining the degradation rate of the degradable metal materials described herein by reference to contact with a specific electrolyte at a specific temperature. The use of the wellbore isolation device 200 having a degradable metal material may be exposed to other wellbore environments to initiate degradation, without departing from the scope of the present disclosure.

It should be further noted, that the non-metal degradable materials also discussed herein, which may be used for forming components of the wellbore isolation device 200 may additionally have a degradation rate in the same range as that of the degradable metal material, which may allow use of certain degradable materials that degrade at a rate faster or slower than other degradable materials (including the degradable metal materials) for forming the wellbore isolation device 200, as discussed in greater detail below.

The degradable metal materials for use in forming at least two components of the wellbore isolation device 200 described herein may include a metal material that is degradable in a wellbore environment, such as in the presence of an electrolyte, as previously discussed. Suitable such degradable metal materials may include, but are not limited to, gold, gold-platinum alloys, silver, nickel, nickel-copper alloys, nickel-chromium alloys, copper, copper alloys (e.g., brass, bronze, etc.), chromium, tin, tin alloys (e.g., pewter, solder, etc.), aluminum, aluminum alloys (e.g., silumin alloy, a magnalium alloy, etc.), iron, iron alloys (e.g., cast iron, pig iron, etc.), zinc, zinc alloys (e.g., zamak, etc.), magnesium, magnesium alloys (e.g., elektron, magnox, etc.), beryllium, berrylium alloys (e.g., beryllium-copper alloys, beryllium-nickel alloys), and any combination thereof.

Suitable magnesium alloys include alloys having magnesium at a concentration in the range of from about 60% to about 99.95% by weight of the magnesium alloy, encompassing any value and subset therebetween. In some embodiments, the magnesium concentration may be in the range of about 60% to about 99.95%, 70% to about 98%, and preferably about 80% to about 95% by weight of the magnesium alloy, encompassing any value and subset therebetween. Each of these values is critical to the embodiments of the present disclosure and may depend on a number of factors including, but not limited to, the type of magnesium alloy, the desired degradability of the magnesium alloy, and the like.

Magnesium alloys comprise at least one other ingredient besides the magnesium. The other ingredients can be selected from one or more metals, one or more non-metals, or a combination thereof. Suitable metals that may be alloyed with magnesium include, but are not limited to, lithium, sodium, potassium, rubidium, cesium, beryllium, calcium, strontium, barium, aluminum, gallium, indium, tin, thallium, lead, bismuth, scandium, titanium, vanadium, chromium, manganese, iron, cobalt, nickel, copper, zinc, yttrium, zirconium, niobium, molybdenum, ruthenium, rhodium, palladium, praseodymium, silver, lanthanum, hafnium, tantalum, tungsten, terbium, rhenium, osmium, iridium, platinum, gold, neodymium, gadolinium, erbium, oxides of any of the foregoing, and any combinations thereof.

Suitable non-metals that may be alloyed with magnesium include, but are not limited to, graphite, carbon, silicon, boron nitride, and combinations thereof. The carbon can be in the form of carbon particles, fibers, nanotubes, fullerenes, and any combination thereof. The graphite can be in the form of particles, fibers, graphene, and any combination thereof. The magnesium and its alloyed ingredient(s) may be in a solid solution and not in a partial solution or a compound where inter-granular inclusions may be present. In some embodiments, the magnesium and its alloyed ingredient(s) may be uniformly distributed throughout the magnesium alloy but, as will be appreciated, some minor variations in the distribution of particles of the magnesium and its alloyed ingredient(s) can occur. In other embodiments, the magnesium alloy is a sintered construction.

Suitable aluminum alloys include alloys having aluminum at a concentration in the range of from about 45% to about 99% by weight of the aluminum alloy, encompassing any value and subset therebetween. For example, suitable magnesium alloys may have aluminum concentrations of about 45% to about 50%, or about 50% to about 60%, about 60% to about 70%, or about 70% to about 80%, or about 80% to about 90%, or about 90% to about 99% by weight of the aluminum alloy, encompassing any value and subset therebetween. Each of these values is critical to the embodiments of the present disclosure and may depend on a number of factors including, but not limited to, the type of aluminum alloy, the desired degradability of the aluminum alloy, and the like.

The aluminum alloys may be wrought or cast aluminum alloys and comprise at least one other ingredient besides the aluminum. The other ingredients can be selected from one or more any of the metals, non-metals, and combinations thereof described above with reference to magnesium alloys, with the addition of the aluminum alloys additionally being able to comprise magnesium.

In some embodiments, the degradable metal materials may be a degradable metal alloy, which may exhibits a nano-structured matrix form and/or inter-granular inclusions (e.g., a magnesium alloy with iron-coated inclusions). Such degradable metal alloys may further include a dopant, where the presence of the dopant and/or the inter-granular inclusions increases the degradation rate of the degradable metal alloy. Other degradable metal materials include solution-structured galvanic material. An example of a solution-structured galvanic material is zirconium (Zr) containing a magnesium (Mg) alloy, where different domains within the alloy contain different percentages of Zr. This leads to a galvanic coupling between these different domains, which causes micro-galvanic corrosion and degradation.

The degradable metal magnesium alloys may be solution structured with other elements such as zinc, aluminum, nickel, iron, carbon, tin, silver, copper, titanium, rare earth elements, and the like, and any combination thereof. Degradable metal aluminum alloys may be solution structured with elements such as nickel, iron, carbon, tin, silver, copper, titanium, gallium, mercury, and the like, and any combination thereof.

In some embodiments, an alloy, such as a magnesium alloy or an aluminum alloy described herein has a dopant included therewith, such as during fabrication. For example, the dopant may be added to one of the alloying elements prior to mixing all of the other elements in the alloy. For example, during the fabrication of an AZ alloy, the dopant (e.g., zinc) may be dissolved in aluminum, followed by mixing with the remaining alloy, magnesium, and other components if present. Additional amounts of the aluminum may be added after dissolving the dopant, as well, without departing from the scope of the present disclosure, in order to achieve the desired composition. Suitable dopants for inclusion in the degradable metal alloy materials described herein may include, but are not limited to, iron, copper, nickel, gallium, carbon, tungsten, and any combination thereof.

The dopant may be included with the magnesium and/or aluminum alloy degradable metal materials described herein in an amount of from about 0.05% to about 15% by weight of the degradable metal material, encompassing every value and subset therebetween. For example, the dopant may be present in an amount of from about 0.05% to about 3%, or about 3% to about 6%, or about 6% to about 9%, or about 9% to about 12%, or about 12% to about 15% by weight of the degradable metal material, encompassing every value and subset therebetween. Other examples include a dopant in an amount of from about 1% to about 10% by weight of the degradable metal material, encompassing every value and subset therebetween. Each of these values is critical to the embodiments of the present disclosure and may depend on a number of factors including, but not limited to, the type of magnesium and/or aluminum alloy selected, the desired rate of degradation, the wellbore environment, and the like, and any combination thereof.

As previously described, one or more first components and one or more second components of the wellbore isolation device 200 described herein are composed of a degradable metal material, such as a degradable aluminum or magnesium alloy, that degrades when exposed to a wellbore environment. Accordingly, at least two components of the wellbore isolation device 200 are composed of a degradable metal material, and each of the two components is fabricated by a different fabrication method. Suitable fabrication methods for the two or more components composed of the degradable metal material may include, but are not limited to, casting, forging, extruding, stamping, sintering, molding, rolling, pressing, printing, and any combination thereof.

As used herein, the term "casting," and grammatical variants thereof, refers to a manufacturing process in which a mold is filled with a liquefied material (e.g., the degradable metal material described herein). The term "forging," and grammatical variants thereof, refers to a manufacturing process in which a component object (e.g., of the wellbore isolation device) is shaped by heating (e.g., by fire or furnace) and mechanical coercion (e.g., beating or hammering). The term "extruding," and grammatical variants thereof, refers to shaping a non-liquefied material (e.g., the degradable metal material) into a component object (e.g., of the wellbore isolation device) by forcing it through a die. As used herein, the term "stamping," and grammatical variants thereof, refers to impressing a pattern, mark, or shape onto a non-liquefied material (e.g., the degradable metal material). The term "stamping" also includes pressing and embossing.

"Sintering," and grammatical variants thereof, refers to coalescing powdered material (e.g., the degradable metal material) into a solid or porous mass by heating, and sometimes compressing, without liquefaction. As used herein, the term "molding," and grammatical variants thereof, refers to a non-liquefied material shaped with a mold. The term "rolling," and grammatical variants thereof, refers to shaping a non-liquefied material (e.g., the degradable metal material) into a component object (e.g., of the wellbore isolation device) by moving or turning over repeatedly on an axis. The term "pressing," refers to using pressure to shape a component object. As used herein, the term "printing" refers to 3D printing using a successive layers of a thin material to form a component object (e.g., using a laser to melt a powder substance).

In some embodiments, a single component of the wellbore isolation device may be fabricated using a dual or multiple-step fabrication method combining one or more of the aforementioned fabrication methods. For example, in some embodiments, a particular component of the wellbore isolation device 200 may be first cast, but prior to hardening extruded through a die. Accordingly, that component is considered using a single fabrication method that has two steps: casting followed by extrusion. Alternatively, the component may be first cast, later extruded, and then later rolled, such that there are three steps in the single fabrication method. It will be appreciated that multiple fabrication methods may be combined, without departing from the scope of the present disclosure.

After the one or more fabrication steps is completed and no further fabrication steps are to be employed for forming a particular component of the degradable metal materials described herein, the component may require cooling and hardening prior to use in the wellbore isolation device 200. As used herein, the term "hardening," and grammatical variants thereof with reference to the fabrication methods for forming components comprising the degradable metal materials of the present disclosure means that the component exemplifies a yield stress for performing the function of the component. That is, the term "hardening" or "hardened" does not imply that the degradable metal material after fabrication lacks some degree of elasticity. For example, a component fabricated of a degradable magnesium alloy may have a yield stress in the range of from about 20000 pounds per square inch (psi) to about 60000 psi, encompassing any value and subset therebetween. For example, in some embodiments, the magnesium alloy may have a yield stress of about 20000 psi to about 30000 psi, or about 30000 psi to about 40000 psi, or about 40000 psi to about 50000 psi, or about 50000 psi to about 60000 psi, encompassing any value and subset therebetween, each critical to the embodiments of the present disclosure.

Accordingly, the one or more first components of the wellbore isolation device is composed of a degradable metal material fabricated by a first fabrication method and the one or more second components of the wellbore isolation device is composed of the same or different degradable metal material fabricated by a second fabrication method that is different than the first fabrication method. For example, the one or more first components may be fabricated by casting or molding, and the one or more second components may be fabricated by the other of casting or molding that is not used to fabricate the one or more first components. For example, the wellbore isolation device 200 may have components comprising the mandrel 206, the mule shoe 222, and at least one component of an anchoring device (i.e., slips 216*a,b*, wedges 218*a,b*, and packer elements 220). In some embodiments, the one or more first components may be the mandrel 206 and the one or more first components may be the mule shoe 222, and further the mandrel 206 may be fabricated by extruding and the mule shoe 222 may be fabricated by casting. It will be appreciated in such an example that extruding the mandrel 206 can maximize the strength of the mandrel 206 whereas casting the mule shoe 222 can minimize costs.

As another example, the wellbore isolation device 200 may have components including a mandrel 206 and a frac ball 208, and the mandrel 206 may be composed of a degradable metal material formed from a first fabrication method, such as extruding fabrication method, and the frac ball 208 may be composed of the same or a different degradable metal material formed from a second fabrication method, such as a casting fabrication method. In other embodiments, all components of the wellbore isolation device 200 except the frac ball 208 may be composed of a degradable metal material formed from a first fabrication method, such as extruding fabrication method, and the frac ball 208 may be composed of the same or a different degradable metal material formed from a second fabrication method, such as a casting fabrication method.

As another example, an aluminum alloy may be designed for the extruding fabrication method and a magnesium alloy may be designed for the casting fabrication method. These same designed alloys, however, may be used opposite, where the aluminum alloy is used in the casting fabrication method and the magnesium alloy is used in the extruding fabrication method, thus resulting in differing properties thereof, including degradation rates. In another embodiment, an aluminum alloy may be designed for the casting fabrication method and a magnesium alloy may be designed for the extruding fabrication method. It will be appreciated that in some instances a degradable metal material may degrade or have identical structural properties regardless of the fabrication method, without departing from the scope of the present disclosure.

Moreover, identical degradable metal materials may be used in different fabrication methods, where such different fabrication methods result in different degradation rates of the degradable metal material. For instance, a magnesium alloy formed by the casting fabrication method will have a faster degradation rate than the same magnesium alloy forming the same component but fabricated using the extruding fabrication method. The cold working of the degradable metal material may be used to adjust the degradation rate, as well. Work hardening, such as through cold working, is the strengthening of the degradable metal material through plastic deformation. Such strengthening results because of grain dislocation that occurs within the structure of the degradable metal material. Other properties, such as degradation rate, may be modified through such grade dislocation during work hardening.

In some embodiments, the degradable metal materials may be fabricated as described herein using different heat treatments (e.g., for hardening) and therefore exhibit varying grain structures or precipitation structures. As an example, in some magnesium alloys, the beta phase can cause accelerated corrosion if it occurs in isolated particles. Homogenization annealing for various times and temperatures causes the beta phase to occur in isolated particles or in a continuous network. In this way, the corrosion behavior can be very different for the same alloy with different heat treatments.

In other embodiments, the one or more components of the wellbore isolation device 200 may comprise a combination of at least two dissimilar degradable metal materials, which results in the generation of a galvanic coupling that either accelerates or decelerates the degradation rate of the component. As will be appreciated, such embodiments may depend on where the dissimilar metals lie on the galvanic potential. In at least one embodiment, a galvanic coupling may be generated by embedding a cathodic substance or piece of material into an anodic structural element. For instance, the galvanic coupling may be generated by dissolving aluminum in gallium. A galvanic coupling may also be generated by using a sacrificial anode coupled to the degradable metal material. In such embodiments, the degradation rate of the degradable metal material may be decelerated until the sacrificial anode is dissolved or otherwise corroded away. As an example, while all of the components of the wellbore isolation device 200 might be made out of a degradable metal material, the mandrel might be a more electronegative material than the wedges or slips. In this instance, the galvanic couple between the mandrel and the wedges/slips would cause the mandrel to act as an anode and degrade before the wedges/slips. Once the mandrel has degraded, the wedges/slips would degrade by themselves.

Moreover, the fabricated components composed of the degradable metal materials of the present disclosure may be used as part of the wellbore isolation device 200 without further processing, or may be further processed, such as by machining, welding, polishing, brazing, or any combination thereof, without departing from the scope of the present disclosure. Such additional processing is not comprised in the fabrication methods described herein, which is solely limited to forming the degradable metal material components.

Accordingly, the one or more first components and the one or more second components may have different degradation rates, where one is faster or slower than the other. For example, if all the components of the wellbore isolation device 200 exhibited the same degradation rate, the upper and lower slips 216*a,b* may degrade to a point that disengages the wellbore isolation device 200 before the mandrel 206 and the mule shoe 222 fully degrade. In such a scenario, non-degraded portions of the wellbore isolation device 200 could flow uphole, including large portions of the mandrel 206 and the mule shoe 222, and potentially disrupt subsequent wellbore operations. Thus designing the components of the wellbore isolation device 200 to degrade at varying degradation rates to avoid premature detachment of the wellbore isolation device 200 may be accomplished based on the embodiments of the present disclosure.

In some embodiments, two or more of the components may exhibit the same or substantially the same degradation rate and, therefore, may be configured to degrade at about the same rate. In other embodiments, one or more of the components may be configured to degrade or dissolve at a degradation rate that is different from the other components. In at least one embodiment, one or more of the components of the anchoring mechanism may exhibit a degradation rate that is lower (i.e., slower) than the degradation rate of other components to avoid having portions of the wellbore isolation device 200 prematurely detach from the wellbore 106 and flow uphole. Consequently, in at least one embodiment, the upper and lower slips 216*a,b*, the upper and lower slip wedges 218*a,b*, and/or the packer elements 220, which cooperatively anchor the wellbore isolation device 200 in the wellbore 106 (the anchoring mechanism), may exhibit a degradation rate that is lower (i.e., slower) than the mandrel 206, the mule shoe 222, the frac ball 208, or other components of the wellbore isolation device 200. In such embodiments, the mandrel 206, the mule shoe 222, and the frac ball 208 (and other components) will degrade or otherwise dissolve prior to the degradation of the upper and lower slips 216*a,b*, the upper and lower slip wedges 218*a,b*, and the packer elements 220.

In some embodiments, one or more components of the wellbore isolation device 200 may be composed of a degradable material that is not a degradable metal material. In yet other embodiments, one or more components of the wellbore isolation device may be composed of a non-degradable material, such as a metal.

For example, the packer elements 220 is a resilient (e.g., elastic) material capable of expanding (and, in some instances, relaxing from an expanded configuration) to provide a fluid seal between two wellbore 106 sections, as previously discussed. The packer elements 220 may thus be an elastomeric material, including non-degradable and degradable elastomeric materials. For example, the elastomer for forming the packer element(s) 220 may include, but are not limited to, polypropylene, polyethylene, styrene divinyl benzene, polyisoprene, polybutadiene, polyisobutylene, polyurethane, a block polymer of styrene, a styrene-isoprene block copolymer, a styrene-butadiene random copolymer, a styrene-butadiene block copolymer, acrylonitrile butadiene, acrylonitrile-styrene-butadiene, natural rubber, polyurethane rubber, polyester-based polyurethane rubber, polyether-based polyurethane rubber, a thiol-based rubber, a hyaluronic acid rubber, a polyhydroxobutyrate rubber, a nitrile rubber, ethylene propylene rubber, ethylene propylene diene M-class rubber, polyisobutene rubber, hydrogenated nitrile rubber, acrylate butadiene rubber, polyacrylate rubber, butyl rubber, norbornene rubber, polynorbornene rubber, isobutylene rubber, brominated butyl rubber, chlorinated butyl rubber, chlorinated polyethylene rubber, isoprene rubber, choloroprene rubber, neoprene rubber, butadiene rubber, styrene butadiene copolymer rubber, sulphonated polyethylene, ethylene acrylate rubber, epichlorohydrin ethylene oxide copolymer rubber, ethylene-propylene-copolymer that is peroxide cross-linked, ethylene-propylene-copolymer that is sulphur cross-linked, ethylene-propylene-diene terpolymer rubber, ethylene vinyl acetate copolymer, a fluoro rubber, a fluoro silicone rubber, a silicone rubber, poly 2,2,1-bicyclo heptene (polynorborneane), alkylstyrene, crosslinked substituted vinyl acrylate copolymer, polymethacrylate, polyacrylamide, a non-soluble acrylic polymer, starch-polyacrylate acid graft copolymer and salts thereof, a polyethylene oxide polymer, a carboxymethyl cellulose type polymer, poly(acrylic acid) and salts thereof, poly(acrylic-co-acrylamide) and salts thereof, graft-poly(ethylene oxide) of poly(acrylic acid) and salts thereof, poly(2-hydroxyethyl methacrylate), poly(2-hydroxypropyl methacrylate), polyvinyl alcohol cyclic acid anhydride graft copolymer, isobutylene maleic anhydride, vinylacetate-acrylate copolymer, starch-polyacrylonitrile graft copolymer, a polyester elastomer; a polyester amide elastomer; a starch-based resin (e.g., starch-poly(ethylene-co-vinyl alcohol), a starch-polyvinyl alcohol, a starch-polylactic acid, starch-polycaprolactone, starch-poly(butylene succinate), and the like); a polyethylene terephthalate polymer; a polyester thermoplastic (e.g., polyether/ester copolymers, polyester/ester copolymers, and the like); copolymers thereof; terpolymers thereof; and any combination thereof.

In some embodiments, the packer elements 220 may be degradable and be composed of a degradable elastomer including those listed above, such as a polyurethane rubber; a polyester-based polyurethane rubber; a polyether-based polyurethane rubber; a thiol-based polymer; a hyaluronic acid rubber; a polyhydroxobutyrate rubber; a polyester elastomer; a polyester amide elastomer; a starch-based resin (e.g., starch-poly(ethylene-co-vinyl alcohol), a starch-polyvinyl alcohol, starch-polycaprolactone, starch-poly(butylene succinate), and the like); a polyethylene terephthalate polymer; a polyester thermoplastic (e.g., polyether/ester copolymers, polyester/ester copolymers, and the like); copolymers thereof; terpolymers thereof; and any combination thereof.

Other degradable materials for forming one or more components of the wellbore isolation device 200 that are not degradable metal materials may include, but are not limited to, any of those elastomeric materials described with reference to the packer elements 220, borate glass, degradable polymers, dehydrated salts, and any combination thereof. These degradable materials may be configured to degrade by a number of mechanisms including, but not limited to, swelling, dissolving, undergoing a chemical change, electrochemical reactions, undergoing thermal degradation, or any combination of the foregoing.

Degradation by swelling involves the absorption by the degradable material of aqueous fluids or hydrocarbon fluids present within the wellbore environment such that the mechanical properties of the thereof degrade or fail. Exemplary hydrocarbon fluids that may swell and degrade certain degradable materials described herein may include, but are not limited to, crude oil, a fractional distillate of crude oil, a saturated hydrocarbon, an unsaturated hydrocarbon, a branched hydrocarbon, a cyclic hydrocarbon, and the like, and any combination thereof. Exemplary aqueous fluids that may swell to degrade certain degradable materials described herein may include, but are not limited to, fresh water, saltwater (e.g., water containing one or more salts dissolved therein), brine (e.g., saturated salt water), seawater, acid, bases, and the like, and any combinations thereof. In degradation by swelling, the degradable material continues to absorb the aqueous and/or hydrocarbon fluid until its mechanical properties are no longer capable of maintaining the integrity of the thereof and it at least partially falls apart. In some embodiments, the degradable material may be designed to only partially degrade by swelling in order to ensure that the mechanical properties of the component formed from the degradable material is sufficiently capable of lasting for the duration of the specific operation in which it is utilized.

Degradation by dissolving involves a degradable material that is soluble or otherwise susceptible to an aqueous fluid or a hydrocarbon fluid, such that the aqueous or hydrocarbon fluid is not necessarily incorporated into the degradable material (as is the case with degradation by swelling), but becomes soluble upon contact with the aqueous or hydrocarbon fluid. Degradation by undergoing a chemical change may involve breaking the bonds of the backbone of the degradable material (e.g., a polymer backbone) or causing the bonds of the degradable material to crosslink, such that the degradable material becomes brittle and breaks into small pieces upon contact with even small forces expected in the wellbore environment. Thermal degradation of the degradable material involves a chemical decomposition due to heat, such as the heat present in a wellbore environment. Thermal degradation of some degradable materials mentioned or contemplated herein may occur at wellbore environment temperatures that exceed about 49° C. (or about 120° F.). For example, the wellbore environment temperature may exceed about 93° C. (or about 120° F.).

With respect to degradable polymers used as a degradable material, a polymer is considered to be "degradable" if the degradation is due to, in situ, a chemical and/or radical process such as hydrolysis, oxidation, or UV radiation. Degradable polymers, which may be either natural or synthetic polymers, include, but are not limited to, polyacrylics, polyamides, and polyolefins such as polyethylene, polypropylene, polyisobutylene, and polystyrene. Suitable examples of degradable polymers that may be used in accordance with the embodiments of the present disclosure may include, but are not limited to, polysaccharides such as dextran or cellulose, chitins, chitosans, proteins, aliphatic polyesters, poly(lactides), poly(glycolides), poly(ε-caprolactones), poly (hydroxybutyrates), poly(anhydrides), aliphatic or aromatic polycarbonates, poly(orthoesters), poly(amino acids), poly (ethylene oxides), polyphosphazenes, poly(phenyllactides), polyepichlorohydrins, copolymers of ethylene oxide/polyepichlorohydrin, terpolymers of epichlorohydrin/ethylene oxide/allyl glycidyl ether, and any combination thereof. Of these degradable polymers, as mentioned above, polyglycolic acid and polylactic acid may be preferred. Polyglycolic acid and polylactic acid tend to degrade by hydrolysis as the temperature increases.

Polyanhydrides are another type of particularly suitable degradable polymer useful in the embodiments of the present disclosure. Polyanhydride hydrolysis proceeds, in situ, via free carboxylic acid chain-ends to yield carboxylic acids as final degradation products. The erosion time can be varied over a broad range of changes in the polymer backbone. Examples of suitable polyanhydrides include poly(adipic anhydride), poly(suberic anhydride), poly(sebacic anhydride), and poly(dodecanedioic anhydride). Other suitable examples include, but are not limited to, poly(maleic anhydride) and poly(benzoic anhydride).

A dehydrated salt is suitable for use in the embodiments of the present disclosure if it will degrade over time as it hydrates. For example, a particulate solid anhydrous borate material that degrades over time may be suitable. Specific examples of particulate solid anhydrous borate materials that may be used include, but are not limited to, anhydrous sodium tetraborate (also known as anhydrous borax), and anhydrous boric acid. These anhydrous borate materials are only slightly soluble in water. However, with time and heat in a subterranean environment, the anhydrous borate materials react with the surrounding aqueous fluid and are hydrated. The resulting hydrated borate materials are highly soluble in water as compared to anhydrous borate materials and as a result degrade in the aqueous fluid. In some instances, the total time required for the anhydrous borate materials to degrade in an aqueous fluid is in the range of from about 8 hours to about 72 hours depending upon the temperature of the subterranean zone in which they are placed. Other examples include organic or inorganic salts like acetate trihydrate.

In some embodiments, the degradable non-metal material may have a thermoplastic polymer embedded therein. The thermoplastic polymer may modify the strength, resiliency, or modulus of the component and may also control the degradation rate of the component. Suitable thermoplastic polymers may include, but are not limited to, an acrylate (e.g., polymethylmethacrylate, polyoxymethylene, a polyamide, a polyolefin, an aliphatic polyamide, polybutylene terephthalate, polyethylene terephthalate, polycarbonate, polyester, polyethylene, polyetheretherketone, polypropylene, polystyrene, polyvinylidene chloride, styrene-acrylonitrile), polyurethane prepolymer, polystyrene, poly(o-methylstyrene), poly(m-methylstyrene), poly(p-methylstyrene), poly(2,4-dimethylstyrene), poly(2,5-dimethylstyrene), poly (p-tert-butylstyrene), poly(p-chlorostyrene), poly(α-methylstyrene), co- and ter-polymers of polystyrene, acrylic resin, cellulosic resin, polyvinyl toluene, and any combination thereof. Each of the foregoing may further comprise acrylonitrile, vinyl toluene, or methyl methacrylate.

The amount of thermoplastic polymer that may be embedded in the degradable non-metal material forming the component may be any amount that confers a desirable elasticity without affecting the desired amount of degradation, such as for use as the packer element(s) 220. In some embodiments, the thermoplastic polymer may be included in an amount of from about 1% to about 91% by weight of the degradable non-metal material, encompassing any value or subset therebetween. For example, the thermoplastic may be present of from about 1% to about 18%, or about 18% to about 36%, or about 36% to about 54%, or about 54% to about 72%, or about 72% to about 90% by weight of the degradable non-metal material, encompassing any value or subset therebetween. Each of these values is critical to the embodiments of the present disclosure and may depend on a number of factors including, but not limited to, the desired elasticity, the desired degradation rate, the wellbore environment, and the like, and any combination thereof.

In some embodiments, the degradable materials (collectively encompassing degradable metal materials and degradable non-metal materials) may release an accelerant during degradation that accelerates the degradation of the component itself or an adjacent component of the wellbore isolation device 200. In at least one embodiment, for instance, one or more of the components may be configured to release the accelerant to initiate and accelerate degradation of its own degradable material. In other cases, the accelerant may be embedded in (e.g., encompassed or encased, for example) or otherwise mixed with the degradable material of one or more of the components and is gradually released as the corresponding component degrades. In some embodiments, for example, the accelerant is a natural component released upon degradation of the degradable material, such as an acid (e.g., release of an acid upon degradation of the degradable material formed from a polylactide). Similarly, degradation of the degradable material may release a base that would aid in degrading the component, such as, for example, if the degradable material a degradable metal material, as described herein. As will be appreciated, the accelerant may comprise any form, including a solid form or a liquid form.

Suitable accelerants may include, but are not limited to, a crosslinker, sulfur, a sulfur-releasing agent, a peroxide, a peroxide releasing agent, a catalyst, an acid releasing agent, a base releasing agent, and any combination thereof. In some embodiments, the accelerant may cause the degradable material to become brittle to aid in degradation. Specific accelerants may include, but are not limited to, a polylactide, a polyglycolide, an ester, a cyclic ester, a diester, an anhydride, a lactone, an amide, an anhydride, an alkali metal alkoxide, a carbonate, a bicarbonate, an alcohol, an alkali metal hydroxide, ammonium hydroxide, sodium hydroxide, potassium hydroxide, an amine, an alkanol amine, an inorganic acid or precursor thereof (e.g., hydrochloric acid, hydrofluoric acid, ammonium bifluoride, and the like), an organic acid or precursor thereof (e.g., formic acid, acetic acid, lactic acid, glycolic acid, aminopolycarboxylic acid, polyaminopolycarboxylic acid, and the like), and any combination thereof.

When embedded in the degradable material, the accelerant may be present in the range of from about 0.001% to about 25% by weight of the material forming the degradable material, encompassing any value and subset therebetween. For example, the accelerant may be present of from about 0.001% to about 5%, or about 5% to about 10%, or about 10% to about 15%, or about 15% to about 20%, or about 20% to about 25% by weight of the material forming the degradable material, encompassing any value and subset therebetween. Each of these values is critical to the embodiments of the present disclosure and depend on a number of factors including, but not limited to, the desired degradation rate, the type of degradable material, the fabrication of a degradable metal material if applicable, the type of accelerant, the wellbore environment, and the like, and any combination thereof.

In some embodiments, the degradable material, including any additional material that may be embedded therein, may be present in a given component of the wellbore isolation device 200 uniformly (i.e., distributed uniformly throughout). In other embodiments, however, the degradable material and any additional material embedded therein may be non-uniformly distributed throughout one or more of the components such that one portion or section of a given component degrades faster or slower than adjacent portions or sections. The choices and relative amounts of each composition or substance may be adjusted for the particular downhole operation (e.g., fracturing, work-over, and the like) and the desired degradation rate (i.e., accelerated, rapid, or normal) of the degradable material for the component. Factors that may affect the selection and amount of compositions or substances may include, for example, wellbore environment, the amount of elasticity required for the component (e.g., based on wellbore diameter, for example), the type of degradable material selected, and the like.

In some embodiments, blends of certain degradable materials may also be suitable as the degradable material for the components of the wellbore isolation device 200. One example of a suitable blend of degradable materials is a mixture of PLA and sodium borate where the mixing of an acid and base could result in a neutral solution where this is desirable. Another example may include a blend of polylactic acid and boric oxide. The blend may additionally include both an aluminum alloy and a magnesium alloy. The choice of blended degradable materials also can depend, at least in part, on the wellbore environment. For instance, lactides have been found to be suitable for lower temperature wells, including those within the range of 60° F. to 150° F., and polylactic acids have been found to be suitable for well bore temperatures above this range. Also, polylactic acid may be suitable for higher temperature wells. Some stereoisomers of poly(lactide) or mixtures of such stereoisomers may be suitable for even higher temperature applications. Dehydrated salts may also be suitable for higher temperature wells. Other blends of degradable materials may include materials that include different alloys including using the same elements but in different ratios or with a different arrangement of the same elements.

In some embodiments, the component formed from the degradable material (e.g., the degradable metal material forming at least two components) or the degradable material itself (e.g., when the degradable material forms only a portion of a component) may be at least partially encapsulated in a second material or "sheath" disposed on all or a portion of a given component of the wellbore isolation device 200. As used herein, the term "at least partially" with reference to the sheath means at least about 20% coverage about a surface of a component or a degradable material. The sheath may be configured to help prolong degradation of the given component of the wellbore isolation device 200. The sheath may also serve to protect the component from abrasion within the wellbore 106. The sheath may be permeable, frangible, or comprise a material that is at least partially removable at a desired rate within the wellbore environment. In either scenario, the sheath may be designed such that it does not interfere with the ability of the wellbore isolation device 200 to form a fluid seal in the wellbore 106 or otherwise perform a planned operation.

The sheath may comprise any material capable of use in a wellbore environment and, depending on the component that the sheath encapsulates, the sheath may or may not be elastic such that it is able to expand with corresponding expansion of the component. A frangible sheath may break as the packer elements 220, for instance, expand to form a fluid seal, whereas a permeable sheath may remain in place on the packer elements 220 as they form the fluid seal. As used herein, the term "permeable" refers to a structure that permits fluids (including liquids and gases) therethrough and is not limited to any particular configuration.

The sheath may comprise any of the afore-mentioned degradable materials. In some embodiments, the sheath may be made of a degradable material that degrades at a rate that is faster than that of the underlying degradable material that forms the component. Other suitable materials for the sheath include, but are not limited to, a TEFLON® coating, a wax, a drying oil, a polyurethane, an epoxy, a crosslinked partially hydrolyzed polyacrylic, a silicate material, a glass, an inorganic durable material, a polymer, polylactic acid, polyvinyl alcohol, polyvinylidene chloride, a hydrophobic coating, paint, and any combination thereof.

In some embodiments, all or a portion of the outer surface of a given component of the wellbore isolation device 200 may be treated to impede degradation. For example, the outer surface of a given component may undergo a treatment that aids in preventing the degradable metal material from galvanically corroding. Suitable treatments include, but are not limited to, an anodizing treatment, an oxidation treatment, a chromate conversion treatment, a dichromate treatment, a fluoride anodizing treatment, a hard anodizing treatment, and any combination thereof. Some anodizing treatments may result in an anodized layer of material being deposited on the outer surface of a given component. The anodized layer may comprise materials such as, but not limited to, ceramics, metals, polymers, epoxies, elastomers, or any combination thereof and may be applied using any suitable processes known to those of skill in the art. Examples of suitable processes that result in an anodized layer include, but are not limited to, soft anodize coating, anodized coating, electroless nickel plating, hard anodized coating, ceramic coatings, carbide beads coating, plastic coating, thermal spray coating, high velocity oxygen fuel (HVOF) coating, a nano HVOF coating, a metallic coating.

In some embodiments, all or a portion of the outer surface of a given component of the wellbore isolation device 200 may be treated or coated with a substance configured to enhance degradation of the degradable material. For example, such a treatment or coating may be configured to remove a protective coating or treatment or otherwise accelerate the degradation of the given component. An example is a degradable metal material coated with a layer of polyglycolic acid. In this example, the polyglycolic acid would undergo hydrolysis and cause the surrounding fluid to become more acidic, which would accelerate the degradation of the underlying degradable metal material.

Referring again generally to FIG. 2, the frac ball 208 and the mule shoe 222 may be made of a degradable material (e.g., the degradable metal material) that exhibits a first degradation rate $R_1$; the mandrel 206 may be made of a degradable material (e.g., the degradable metal material) that exhibits a second degradation rate $R_2$; and the upper and lower slips 216*a,b* and the upper and lower slip wedges 218*a,b* may be made of a degradable material (e.g., the degradable metal material) that exhibits a third degradation rate $R_3$, where $R_1<R_2<R_3$. Accordingly, in such embodiments, the frac ball 208 and the mule shoe 222 may be configured to degrade first, then the mandrel 206, and lastly the upper and lower slips 216*a,b* and the upper and lower slip wedges 218*a,b*. Such an embodiment may prove advantageous in allowing the frac ball 208, the mule shoe 222, and the mandrel 206 to perform their respective operations (e.g., guiding the wellbore isolation device 200 through the wellbore 106, allowing the wellbore isolation device 200 stroke length to set, and facilitate zonal isolation) and then degrade a short time thereafter while the wellbore isolation device 200 remains anchored in the wellbore 106. Since the mule shoe 222 and the mandrel 206 account for a large portion of the mass of the wellbore isolation device 200, having them dissolve or degrade first may be preferred. The upper and lower slips 216*a,b* and the upper and lower slip wedges 218*a,b* degrade at a slower degradation rate, and thereby allow the wellbore isolation device 200 to remain anchored to the casing 114 while the mule shoe 222 and the mandrel 206 dissolve. In some embodiments, the packer elements 220 may also be made of a degradable material and may be configured to degrade at substantially the same rate as the mandrel 206, the mule shoe 222, the upper and lower slips 216*a,b*, or the upper and lower wedges 218*a,b*. In some embodiments, the packer elements 220 may be degradable at substantially the same rate as the remaining anchor mechanism elements and the upper and lower slips 216*a,b*, or the upper and lower wedges 218*a,b*.

In one or more additional embodiments, all of the components of the wellbore isolation device 200 may be painted or otherwise coated with paint except for the walls of the central flow passage 210 and the frac ball 208. In such embodiments, degradation of the painted components will be substantially prevented or otherwise decelerated. Degradation of the mandrel 206 may proceed outward from the central flow passage 210 and toward the casing 114.

In one or more additional embodiments, the upper and lower slips 216*a,b* and the upper and lower slip wedges 218*a,b* may be highly anodized or otherwise coated with a thicker anodized coating, while the mandrel 206 is weakly anodized or otherwise coated with a thinner anodized coating, and the frac ball 208 is not anodized. In such an embodiment, the frac ball 208 may be configured to degrade first, and the mandrel 206 may degrade at a more rapid degradation rate than the upper and lower slips 216*a,b* and the upper and lower slip wedges 218*a,b*.

In yet one or more additional embodiments, the mandrel 206 may be a nano-structured magnesium alloy with iron-coated inclusions, the upper and lower slip wedges 218*a,b* may be an aluminum-gallium solution, and the upper and lower slips 216*a,b* may be a fiber-reinforced composite, where the two degradable metal material components are fabricated using different fabrication methods. In such an embodiment, the mandrel 206 may be configured to chemically react with the upper and lower slip wedges 218*a,b* and thereby galvanically-corrode, but the upper and lower slips 216*a,b* may degrade at a slower degradation rate.

As previously noted, portions of the wellbore isolation device 200 may be made of any non-degradable material suitable for use in a wellbore environment that does not hinder the operability of the wellbore isolation device, including metals and non-metals, without departing from the scope of the present disclosure.

Embodiments disclosed herein include:

Embodiment A: A downhole tool, comprising: a wellbore isolation device that provides a plurality of components including one or more first components and one or more second components, wherein at least the first and second one or more components are made of a degradable metal material that degrades when exposed to a wellbore environment, and wherein the one or more first components is fabricated by a first fabrication method and the one or more second components is fabricated by a second fabrication method.

Embodiment B: A method, comprising: introducing a wellbore isolation device into a wellbore, the wellbore isolation device providing a plurality of components including one or more first components and one or more second components, wherein at least the first and second one or more components are made of a degradable metal material that degrades when exposed to a wellbore environment, and wherein the one or more first components is fabricated by a first fabrication method and the one or more second components is fabricated by a second fabrication method; anchoring the wellbore isolation device within the wellbore at a target location; performing at least one downhole operation; degrading the one or more first components and the one or more second components.

Embodiment C: A system comprising: a tool string connected to a derrick and extending through a surface into a wellbore in a subterranean formation; and a wellbore isolation device that provides a plurality of components including one or more first components and one or more second components, wherein at least the first and second one or more components are made of a degradable metal material that degrades when exposed to a wellbore environment, and wherein the one or more first components is fabricated by a first fabrication method and the one or more second components is fabricated by a second fabrication method.

Each of embodiments A, B, and C may have one or more of the following additional elements in any combination:

Element 1: Wherein the first fabrication method and the second fabrication method are selected from the group consisting of casting, forging, extruding, stamping, sintering, molding, rolling, pressing, printing, and any combination thereof.

Element 2: Wherein the wellbore isolation device is a frac plug, a bridge plug, a wellbore packer, a wiper plug, a cement plug, a basepipe plug, a sand screen plug, an inflow control device plug, an autonomous inflow control device plug, a tubing section, or a tubing string.

Element 3: Wherein the degradable metal material is an alloy selected from the group consisting of a magnesium alloy, an aluminum alloy, and any combination thereof.

Element 4: Wherein the degradable metal material is an alloy selected from the group consisting of a magnesium alloy, an aluminum alloy, and any combination thereof, and wherein the alloy further comprises a dopant selected from the group consisting of iron, copper, nickel, gallium, carbon, tungsten, and any combination thereof.

Element 5: Wherein the plurality of components includes a mandrel, a mule shoe, and an anchoring mechanism that is actuatable to anchor the wellbore isolation device within a wellbore, wherein the one or more first components includes the mandrel, and the one or more second components includes the mule shoe.

Element 6: Wherein the plurality of components includes a mandrel, a mule shoe, and an anchoring mechanism that is actuatable to anchor the wellbore isolation device within a wellbore, wherein the one or more first components includes the mandrel, and the one or more second components includes the mule shoe, and wherein the first fabrication method is extruding and the second fabrication method is casting.

Element 7: Wherein the one or more first components degrades at a first degradation rate and the one or more second components degrades at a second degradation rate that is slower than the first degradation rate.

Element 8: Wherein the degradable metal material has an average dissolution rate of greater than about 0.01 milligrams per square centimeter per hour at 93° C. in a 15% potassium chloride solution.

Element 9: Wherein the degradable metal material loses greater than about 0.1% of total mass per day at 93° C. in a 15% potassium chloride solution.

By way of non-limiting example, exemplary combinations applicable to A, B, C include: 1, 2, 3, 4, 5, 6, 7, 8, and 9; 1 and 5; 2, 6, and 9; 8 and 9; 3, 5, and 7; 2, 4, and 8; 5, 8, and 9; 1, 4, and 6; and the like.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

What is claimed is:

1. A downhole tool, comprising:

a wellbore isolation device that provides a plurality of components including one or more first components and one or more second components, wherein the wellbore isolation device is a frac plug, a bridge plug, a wellbore packer, a wiper plug, a cement plug, a basepipe plug, a sand screen plug, an inflow control device plug, an autonomous inflow control device plug, a tubing section, or a tubing string, wherein at least the first and second one or more components are made of a degradable metal material that degrades when exposed to a wellbore environment, wherein the first and second one or more components are made of the same degradable metal material, wherein the degradable metal material is an alloy selected from the group consisting of a magnesium alloy, an aluminum alloy, and any combination thereof, wherein the one or more first components is fabricated by a first fabrication method selected from the group consisting of casting, forging, extruding, stamping, sintering, molding, rolling, pressing, printing, and any combination thereof, the one or more second components is fabricated by a second fabrication method selected from a different fabrication method of the group consisting of casting, forging, extruding, stamping, sintering, molding, rolling, pressing, printing, and any combination thereof, and the second fabrication method is different from the first fabrication method, and wherein the one or more first components degrades at a first degradation rate and the one or more second components degrades at a second degradation rate that is slower than the first degradation rate.

2. The downhole tool of claim 1, wherein the alloy further comprises a dopant selected from the group consisting of iron, copper, nickel, gallium, carbon, tungsten, and any combination thereof.

3. The downhole tool of claim 1, wherein the plurality of components includes a mandrel, a mule shoe, and an anchoring mechanism that is actuatable to anchor the wellbore isolation device within a wellbore, wherein the one or more first components includes the mandrel, and the one or more second components includes the mule shoe.

4. The downhole tool of claim 1, wherein the plurality of components includes a mandrel, a mule shoe, and an anchoring mechanism that is actuatable to anchor the wellbore isolation device within a wellbore, wherein the one or more first components includes the mandrel, and the one or more second components includes the mule shoe, and wherein the first fabrication method is extruding and the second fabrication method is casting.

5. The downhole tool of claim 1, wherein the degradable metal material has an average dissolution rate of greater than about 0.01 milligrams per square centimeter per hour at 93° C. in a 15% potassium chloride solution.

6. A method, comprising:

introducing a wellbore isolation device into a wellbore, the wellbore isolation device providing a plurality of components including one or more first components and one or more second components, wherein the wellbore isolation device is a frac plug, a bridge plug, a wellbore packer, a wiper plug, a cement plug, a basepipe plug, a sand screen plug, an inflow control device plug, an autonomous inflow control device plug, a tubing section, or a tubing string, wherein at least the first and second one or more components are made of a degradable metal material that degrades when exposed to a wellbore environment, wherein the first and second one or more components are made of the same degradable metal material, wherein the degradable metal material is an alloy selected from the group consisting of a magnesium alloy, an aluminum alloy, and any combination thereof, wherein the one or more first components is fabricated by a first fabrication method selected from the group consisting of casting, forging, extruding, stamping, sintering, molding, rolling, pressing, printing, and any combination thereof, the one or more second components is fabricated by a second fabrication method selected from a different fabrication method of the group consisting of casting, forging, extruding, stamping, sintering, molding, rolling, pressing, printing, and any combination thereof, and the second fabrication method is different from the first fabrication method, and wherein the one or more first components degrades at a first degradation rate and the one or more second components degrades at a second degradation rate that is slower than the first degradation rate;

anchoring the wellbore isolation device within the wellbore at a target location; performing at least one downhole operation;

degrading the one or more first components and the one or more second components.

7. The method of claim 6, wherein the alloy further comprises a dopant selected from the group consisting of iron, copper, nickel, gallium, carbon, tungsten, and any combination thereof.

8. The method of claim 6, wherein the plurality of components includes a mandrel, a mule shoe, and an anchoring mechanism that is actuatable to anchor the wellbore isolation device within a wellbore, wherein the one or more first components includes the mandrel, and the one or more second components includes the mule shoe.

9. The method of claim 6, wherein the plurality of components includes a mandrel, a mule shoe, and an anchoring mechanism that is actuatable to anchor the wellbore isolation device within a wellbore, wherein the one or more first components includes the mandrel, and the one or more second components includes the mule shoe, and wherein the first fabrication method is extruding and the second fabrication method is casting.

10. A system comprising:

a tool string connected to a derrick and extending through a surface into a wellbore in a subterranean formation; and a wellbore isolation device that provides a plurality of components including one or more first components and one or more second components, wherein the wellbore isolation device is a frac plug, a bridge plug, a wellbore packer, a wiper plug, a cement plug, a basepipe plug, a sand screen plug, an inflow control device plug, an autonomous inflow control device plug, a tubing section, or a tubing string, wherein at least the first and second one or more components are made of a degradable metal material that degrades when exposed to a wellbore environment, wherein the first and second one or more components are made of the same degradable metal material, wherein the degradable metal material is an alloy selected from the group consisting of a magnesium alloy, an aluminum alloy, and any combination thereof, wherein the one or more first components is fabricated by a first fabrication method selected from the group consisting of casting, forging, extruding, stamping, sintering, molding, rolling, pressing, printing, and any combination thereof, the one or more second components is fabricated by a second fabrication method selected from a different fabrication method of the group consisting of casting, forging, extruding, stamping, sintering, molding, rolling, pressing, printing, and any combination thereof, and the second fabrication method is different from the first fabrication method, and wherein the one or more first components degrades at a first degradation rate and the one or more second components degrades at a second degradation rate that is slower than the first degradation rate.

11. The downhole tool of claim 1, wherein the first fabrication method includes extruding and the second fabrication method includes casting.

* * * * *